US010877429B2

(12) United States Patent
Yamasaki

(10) Patent No.: US 10,877,429 B2
(45) Date of Patent: Dec. 29, 2020

(54) FIXING MEMBER AND IMAGE FORMING APPARATUS

(71) Applicant: KYOCERA Document Solutions Inc., Osaka (JP)

(72) Inventor: Shunsuke Yamasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/699,223

(22) Filed: Nov. 29, 2019

(65) Prior Publication Data

US 2020/0174421 A1 Jun. 4, 2020

(30) Foreign Application Priority Data

Nov. 30, 2018 (JP) ..... 2018-224795

(51) Int. Cl.
*G03G 21/16* (2006.01)

(52) U.S. Cl.
CPC ..... *G03G 21/1647* (2013.01); *G03G 21/1685* (2013.01)

(58) Field of Classification Search
CPC ..... G03G 21/1647; G03G 21/1685; F16B 5/0233; F16B 5/0283
USPC ..... 411/411, 424, 546
See application file for complete search history.

(56) References Cited

U.S. PATENT DOCUMENTS 4,022,122 A 5/1977 Moser et al.
4,852,904 A * 8/1989 Yamamoto ..... B60G 7/02 280/124.156
2002/0197130 A1* 12/2002 Ozawa ..... B62D 25/147 411/353
2013/0002758 A1* 1/2013 Navon ..... B41J 25/34 347/37
2019/0048909 A1* 2/2019 Wakabayashi ..... F16B 5/02

FOREIGN PATENT DOCUMENTS

JP H07-168407 A 7/1995
JP 2007079052 A 3/2007

OTHER PUBLICATIONS

The extended European search report issued by the European Patent Office dated May 15, 2020, which corresponds to European Patent Application No. 19212441.0-1010 and is related to U.S. Appl. No. 16/699,223.

* cited by examiner

*Primary Examiner* — Walter L Lindsay, Jr.
*Assistant Examiner* — Milton Gonzalez
(74) *Attorney, Agent, or Firm* — Studebaker & Brackett PC

(57) ABSTRACT

A fixing member includes a bolt member and a spacer annular in shape. The bolt member includes a base portion, a protruding portion protruding from the base portion, and a threaded portion at a tip of the protruding portion. The spacer is attached to the protruding portion in a slidable manner between the base portion and the threaded portion. A first member is sandwiched between the base portion and the spacer. A second member different from the first member is sandwiched between the spacer and a nut member threadedly engaged with the threaded portion.

13 Claims, 11 Drawing Sheets

FIXING MEMBER AND IMAGE FORMING APPARATUS

INCORPORATION BY REFERENCE

The present application claims priority under 35 U.S.C. § 119 to Japanese Patent Application No. 2018-224795, filed on Nov. 30, 2018. The contents of this application are incorporated herein by reference in their entirety.

BACKGROUND

The present disclosure relates to a fixing member and an image forming apparatus.

An image forming apparatus includes a conveyance unit, a swinging body, and a fixing member. The fixing member is a bolt. The fixing member attaches the conveyance unit to the swinging body in a swingable manner. In transportation of the image forming apparatus, the bolt is fastened to render the conveyance unit immovable relative to the swinging body.

SUMMARY

A fixing member in an aspect of the present disclosure includes a bolt member and a spacer annular in shape. The bolt member includes a base portion, a protruding portion protruding from the base portion, and a threaded portion at a tip of the protruding portion. The spacer is attached to the protruding portion in a slidable manner between the base portion and the threaded portion. A first member is sandwiched between the base portion and the spacer. A second member different from the first member is sandwiched between a nut member screwed on the threaded portion and the spacer.

An image forming apparatus according to an aspect of the present disclosure includes a conveyance unit, a lifting and lowering unit, a fixing member, and a nut member. The conveyance unit includes a bottom plate and conveys a sheet. The lifting and lowering unit includes an elastic body and a support plate, and lifts and lowers the conveyance unit. The support plate supports the conveyance unit with the elastic body interposed therebetween. The fixing member fixes the conveyance unit to the lifting and lowering unit. The nut member is attached to the fixing member. The fixing member includes a bolt member and a spacer annular in shape. The bolt member includes a base portion, a protruding portion protruding from the base portion, and a threaded portion located at a tip of the protruding portion. The spacer is attached to the protruding portion in a slidable manner between the base portion and the threaded portion. The bottom plate is sandwiched between the base portion and the spacer. The support plate is sandwiched between the spacer and a nut member threadedly engaged with the threaded portion. The length of the elastic body is maintained at a predetermined length due to the spacer between the bottom plate and the support plate.

DETAILED DESCRIPTION

Figure 1:
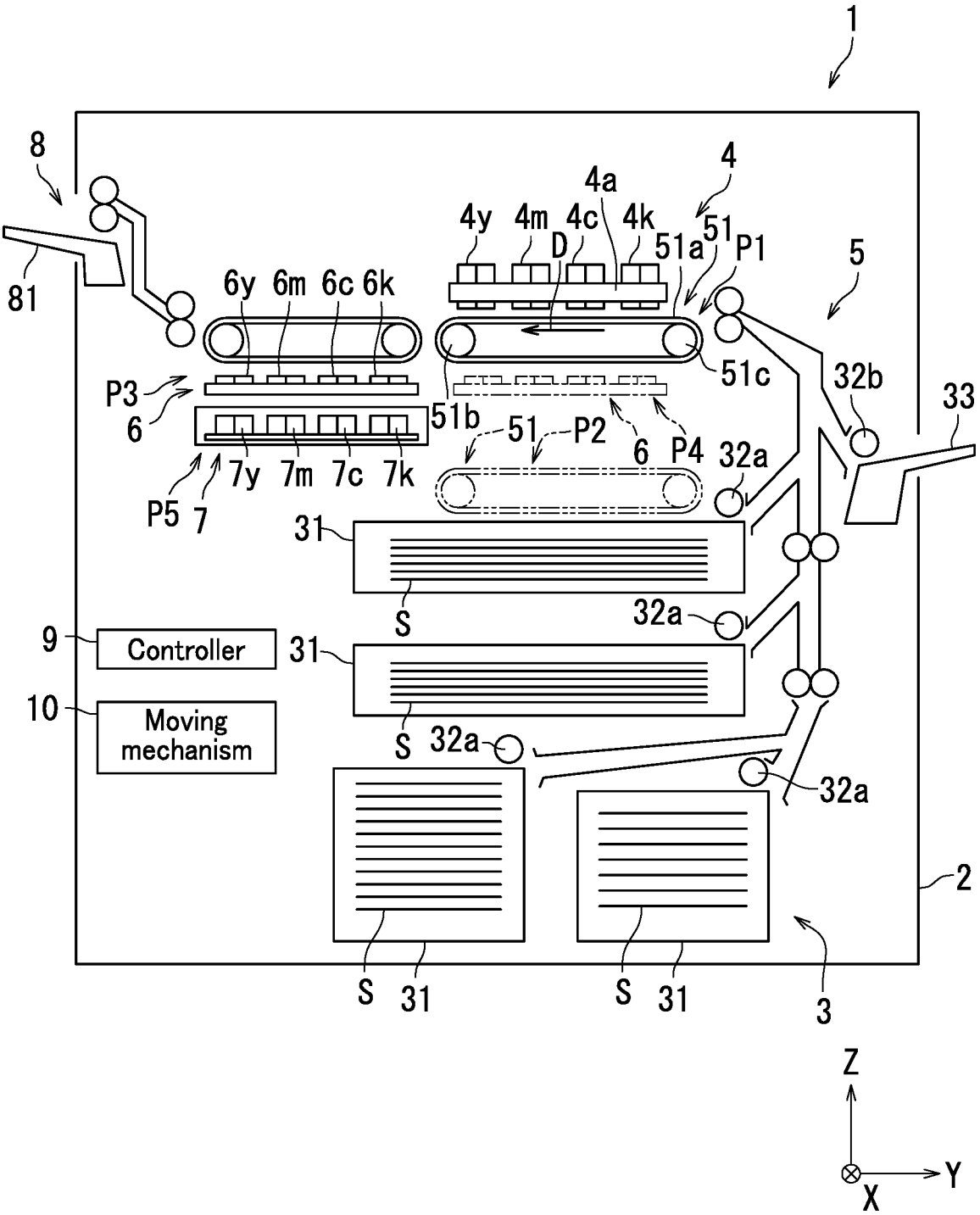
FIG. 1 is a diagram illustrating an inkjet recording apparatus according to an embodiment of the present disclosure.

The following describes an inkjet recording apparatus 1 according to an embodiment of the present disclosure with reference to drawings. The inkjet recording apparatus 1 is an example of an image forming apparatus. Note that elements that are the same or equivalent are indicated by the same reference signs in the drawings and description thereof are not repeated. The drawings mainly illustrate respective elements in a schematic manner for easy understanding.

With reference to FIG. 1, the inkjet recording apparatus 1 according to the present embodiment is described. FIG. 1 is a diagram illustrating the inkjet recording apparatus 1 according to the present embodiment. An X axis, a Y axis, and a Z axis in the drawings are perpendicular to each other. The X axis and the Y axis each extend in a direction parallel to a horizontal direction, and the Z axis extends in a direction parallel to a vertical direction. A Y-axis direction is opposite to a conveyance direction D.

As illustrated in FIG. 1, the inkjet recording apparatus 1 includes a housing 2, a sheet feed section 3, a recording head section 4, a conveyance section 5, a cap unit 6, a wiper unit 7, an ejection section 8, a controller 9, and a moving mechanism 10. The housing 2 accommodates the sheet feed section 3, the recording head section 4, the conveyance section 5, the cap unit 6, the wiper unit 7, the ejection section 8, the controller 9, and the moving mechanism 10.

Figure 2:
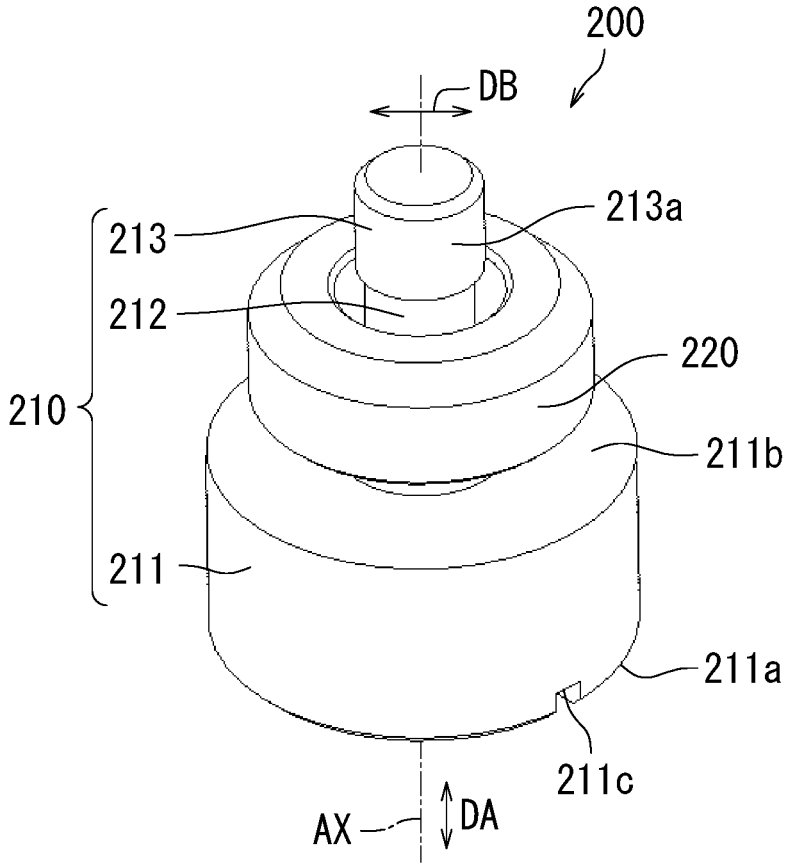
FIG. 2 is a perspective view illustrating a fixing member in the embodiment.
Figure 3:
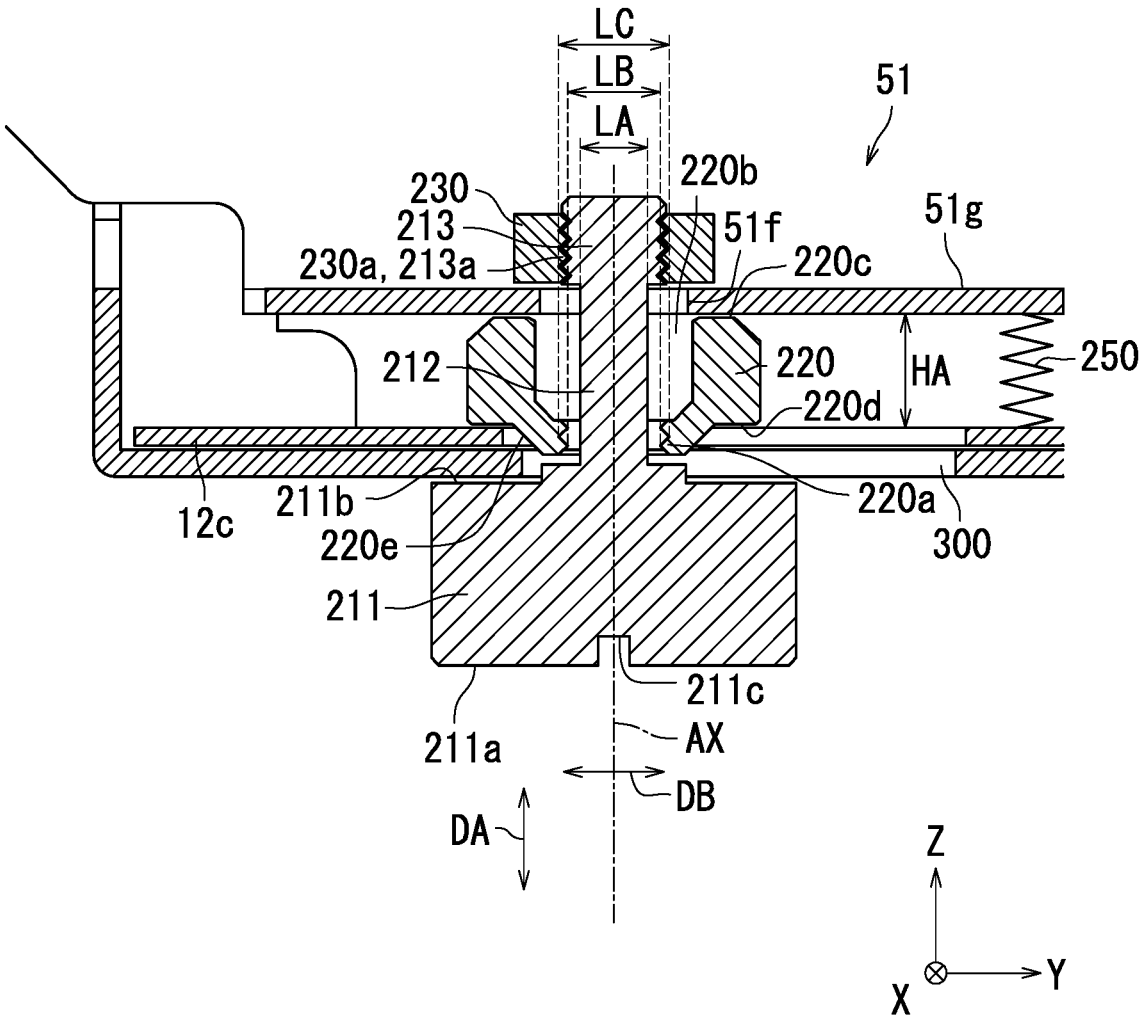
FIG. 3 is a cross-sectional view illustrating the fixing member in the embodiment.

Next, a fixing member 200 in the embodiment is described with reference to FIGS. 2 and 3. FIG. 2 is a perspective view illustrating the fixing member 200. FIG. 3 is a cross-sectional view illustrating the fixing member 200. As illustrated in FIGS. 2 and 3, the inkjet recording apparatus 1 further includes the fixing member 200 and a nut member 230. In the embodiment, the inkjet recording apparatus 1 includes a plurality of fixing members 200 and a plurality of nut members 230. Each of the nut members 230 is attachable to a corresponding one of the fixing members 200. The fixing members 200 are used in transportation of the inkjet recording apparatus 1.

As illustrated in FIG. 1, the sheet feed section 3 includes sheet feed cassettes 31, sheet feed rollers 32*a*, a sheet feed roller 32*b*, and a manual feed tray 33. The sheet feed cassettes 31 are disposed in a lower part of the housing 2. The sheet feed cassettes 31 are detachably attached to the housing 2. In each of the sheet feed cassettes 31, a plurality of sheets S can be stored in a stacked state. A portion of the manual feed tray 33 is exposed from the housing 2 to the outside. On the manual feed tray 33, a plurality of sheets S can be loaded in a stacked state.

Each sheet S is, for example, plain paper, copy paper, recycled paper, thin paper, thick paper, glossy paper, or an overhead projector (OHP) sheet.

The sheet feed rollers 32*a* and the sheet feed roller 32*b* are pickup rollers. Each sheet feed roller 32*a* picks up the sheets S stored in the sheet feed cassette 31 one by one from the top. The sheet feed roller 32*b* picks up the sheets S loaded on the manual feed tray 33 one by one from the top. The sheet feed rollers 32*a* and the sheet feed roller 32*b* each feeds the picked sheet S to the conveyance section 5.

The conveyance section 5 conveys the sheet S along a conveyance path of the sheet S. The conveyance path of the sheet S extends from the sheet feed section 3 to the ejection section 8 via the recording head section 4. The conveyance section 5 includes a conveyance unit 51 and a plurality of roller pairs disposed along the conveyance path.

Figure 4:
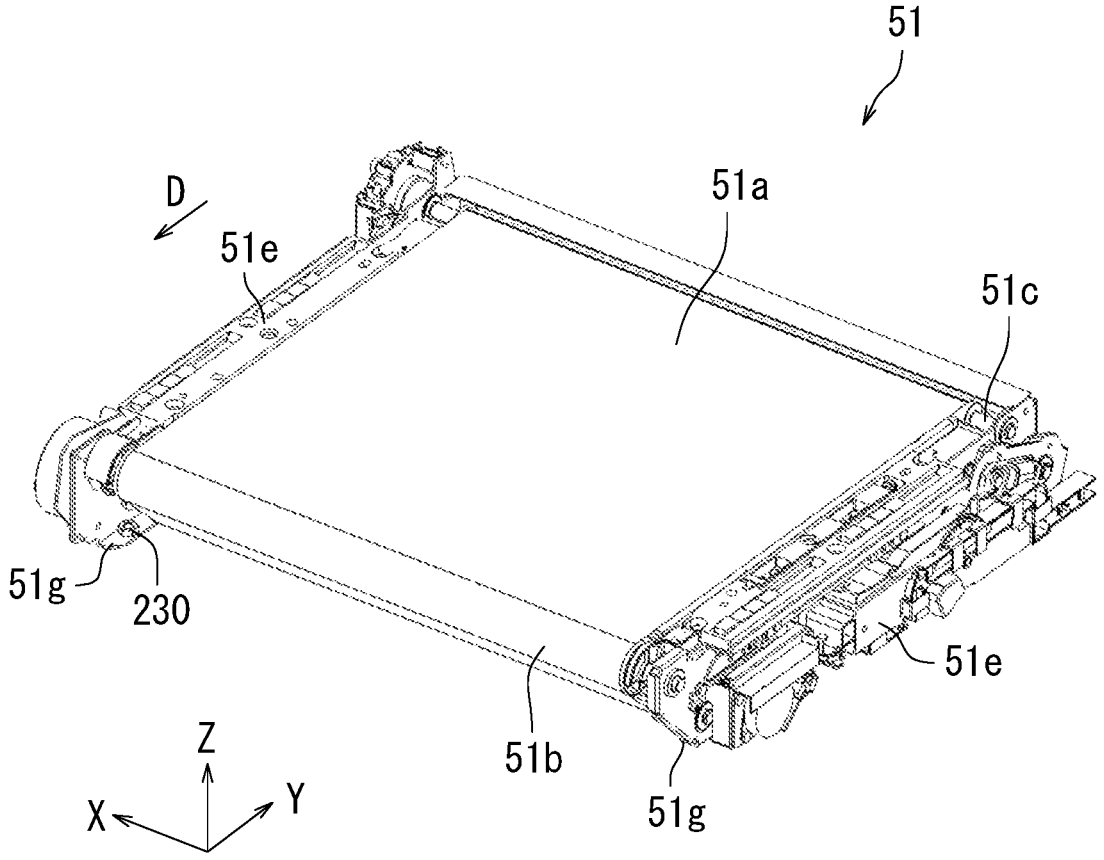
FIG. 4 is a perspective view illustrating a conveyance unit in the embodiment.

Next, with reference to FIG. 4, the conveyance unit 51 in the embodiment is described. FIG. 4 is a perspective view illustrating the conveyance unit 51. As illustrated in FIG. 4, the conveyance unit 51 conveys the sheet S in the conveyance direction D. The conveyance unit 51 includes a conveyor belt 51*a*, a driving roller 51*b*, a driven roller 51*c*, paired wall sections 51*e*, and paired bottom plates 51*g*. A driving roller 51*b* and a driven roller 51*c* are disposed between the paired wall sections 51*e*. The bottom plates 51*g* are each a plate parallel to a horizontal plane. The bottom plates 51*g* form the respective bottoms of the paired wall sections 51*e*.

The conveyor belt 51*a* is an endless belt. The conveyor belt 51*a* is stretched around the driving roller 51*b* and the driven roller 51*c*. The conveyance unit 51 conveys to the ejection section 8 the sheet S with it loaded on a loading surface. The loading surface means a part of an outer circumferential surface of the conveyor belt 51*a* on which the sheet S is to be loaded.

As illustrated in FIG. 3, each of the bottom plates 51*g* of the conveyance unit 51 includes a third hole 51*f*. In the embodiment, the bottom plate 51*g* includes a plurality of third holes 51*f*. Each of the third holes 51*f* penetrates the bottom plate 51*g* in an axial direction DA. The axial direction DA is, for example, substantially parallel to the vertical direction.

The nut member 230 is fixed to the bottom plate 51*g*. Specifically, the nut member 230 is fixed to the upper surface of the bottom plate 51*g* so as to overlap with the third hole 51*f* in the axial direction DA. That is, the nut member 230 is integral with the inkjet recording apparatus 1. Therefore, according to the embodiment, attachment of the fixing member 200 at a predetermined position can be achieved only by preparation of the fixing member 200.

The nut member 230 is an annular body. The nut member 230 is made from, for example, metal. The inner circumferential surface of the nut member 230 has a second female thread 230*a*. The second female thread 230*a* has an inner diameter of a second length LB and a root diameter of a third length LC. The second length LB is smaller than the third length LC.

As illustrated in FIG. 1, the recording head section 4 faces the loading surface of the conveyance unit 51. The recording head section 4 forms an image with ink on the sheet S being conveyed by the conveyance unit 51. Subsequently, the sheet S with the image formed thereon is sent to the ejection section 8.

The recording head section 4 includes a head housing 4*a* and recording heads 4*y*, 4*m*, 4*c*, and 4*k*. The recording heads 4*y*, 4*m*, 4*c*, 4*k* are held by the head housing 4*a*. The recording head 4*y* ejects a yellow ink. The recording head 4*m* ejects a magenta ink. The recording head 4*c* ejects a cyan ink. The recording head 4*k* ejects a black ink.

The ejection section 8 includes an exit tray 81. A portion of the exit tray 81 is exposed from the housing 2 to the outside. The sheet S with the image formed thereon is ejected onto the exit tray 81. Sheets S with an image formed thereon are stacked one by one on the exit tray 81.

The wiper unit 7 includes wiper blades 7*y*, 7*m*. 7*c*, and 7*k*. The wiper blades 7*y*, 7*m*, 7*c*, and 7*k* wipe off inks from the recording head section 4. The wiper blade 7*y* corresponds to the recording head 4*y*. The wiper blade 7*m* corresponds to the recording head 4*m*. The wiper blade 7*c* corresponds to the recording head 4*c*. The wiper blade 7*k* corresponds to the recording head 4*k*.

The cap unit 6 includes caps 6*y*, 6*m*, 6*c*, and 6*k*. The cap 6*y* corresponds to the recording head 4*y*. The cap 6*m* corresponds to the recording head 4*m*. The cap 6*c* corresponds to the recording head 4*c*. The cap 6*k* corresponds to the recording head 4*k*.

For example, the cap unit 6 brings the caps 6*y*, 6*m*, 6*c*, and 6*k* into close contact with the recording heads 4*y*, 4*m*, 4*c*, and 4*k*, respectively, when the recording head section 4 is not used for a specific time period or longer. As a result, drying of the inks of the recording heads 4*y*, 4*m*, 4*c*, and 4*k* is prevented.

The controller 9 controls operation of the inkjet recording apparatus 1. Specifically, the controller 9 includes a processor such as a central processing unit (CPU), and storage such as a hard disk drive and memory. The storage stores therein various computer programs to be executed by the processor. The processor executes the various computer programs stored in the storage to control the sheet feed section 3, the recording head section 4, the conveyance section 5, the cap unit 6, the wiper unit 7, and the moving mechanism 10.

Figure 5:
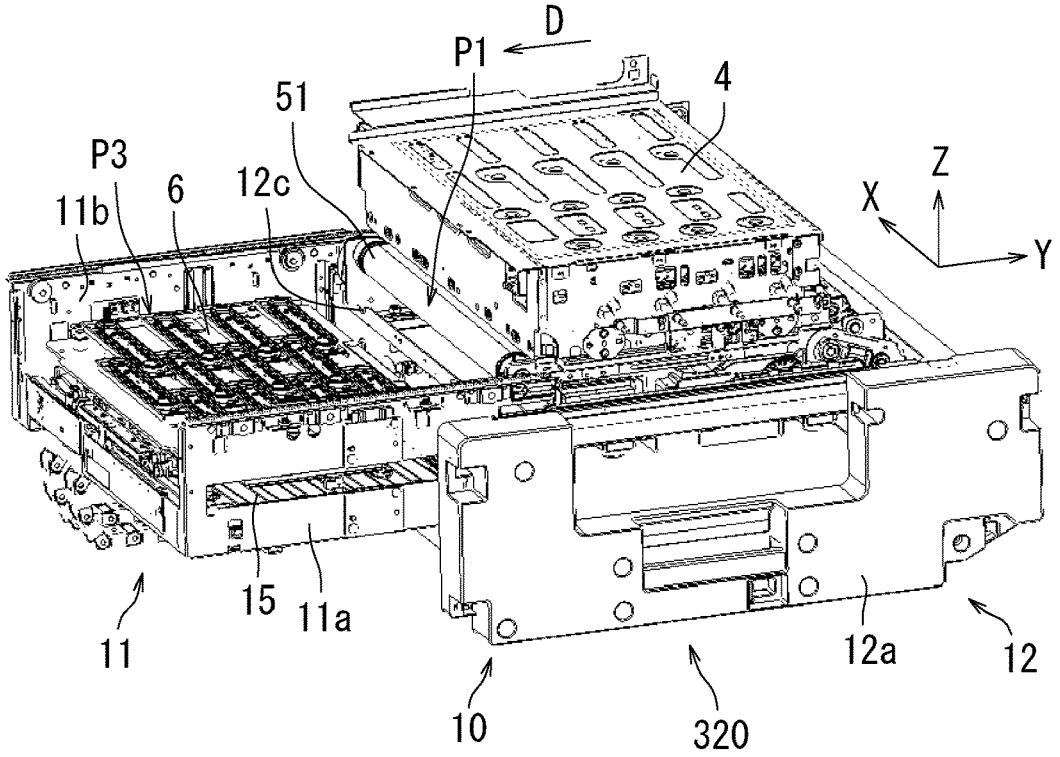
FIG. 5 is a perspective view illustrating a state in which the conveyance unit in the embodiment is located at an upper limit position and a state in which a cap unit and a wiper unit in the embodiment are located at a retraction position.
Figure 6:
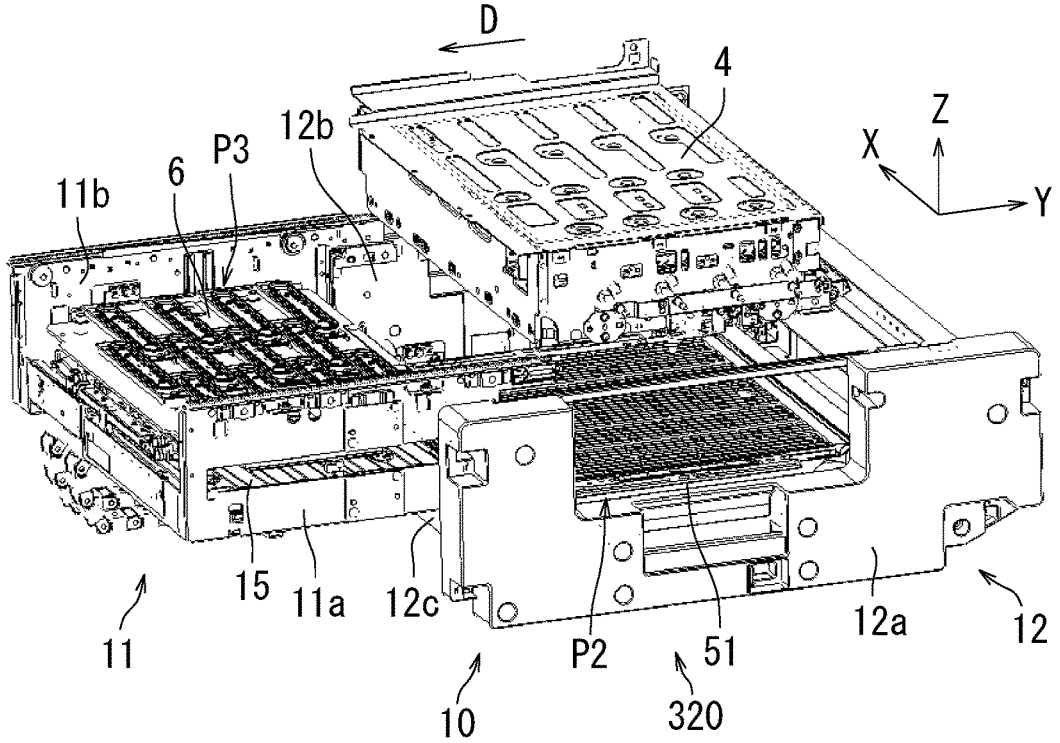
FIG. 6 is a perspective view illustrating a state in which the conveyance unit in the embodiment is located at a lower limit position and a state in which the cap unit and the wiper unit in the embodiment are located at the retraction position.

Next, with reference to FIGS. 5 to 6, movement of the conveyance unit 51, the cap unit 6, and the wiper unit 7 is described in detail. FIGS. 5 and 6 are perspective views illustrating the conveyance unit 51, the cap unit 6, and the wiper unit 7. In FIG. 5, the conveyance unit 51 is located at an upper limit position P1 and the cap unit 6 is located at a retraction position P3. In this state, the wiper unit 7 illustrated in FIG. 1 is located at a retraction position P5 although the wiper unit 7 is hidden behind the cap unit 6 in FIG. 5. In FIG. 6, the conveyance unit 51 is located at a lower limit position P2 and the cap unit 6 is located at the retraction position P3. In this state, the wiper unit 7 illustrated in FIG. 1 is located at a retraction position P5 although the wiper unit 7 is hidden behind the cap unit 6 in FIG. 5.

The upper limit position P1 is a position at which the conveyance unit 51 is close to the recording head section 4. The lower limit position P2 is a position which is vertically below the upper limit position P1 and at which the conveyance unit 51 is away from the recording head section 4. The retraction position P3 is a position to which the cap unit 6 is moved in the conveyance direction D relative to the recording head section 4. The retraction position P5 is a position which is vertically below the retraction position P3 and to which the wiper unit 7 is moved in the conveyance direction D relative to the recording head section 4.

As illustrated in FIGS. 5 to 6, the moving mechanism 10 moves the conveyance unit 51, the cap unit 6, and the wiper unit 7 within the housing 2. The moving mechanism 10 includes a first casing 11, a first casing moving mechanism 15, and a lifting and lowering unit 320.

Figure 7:
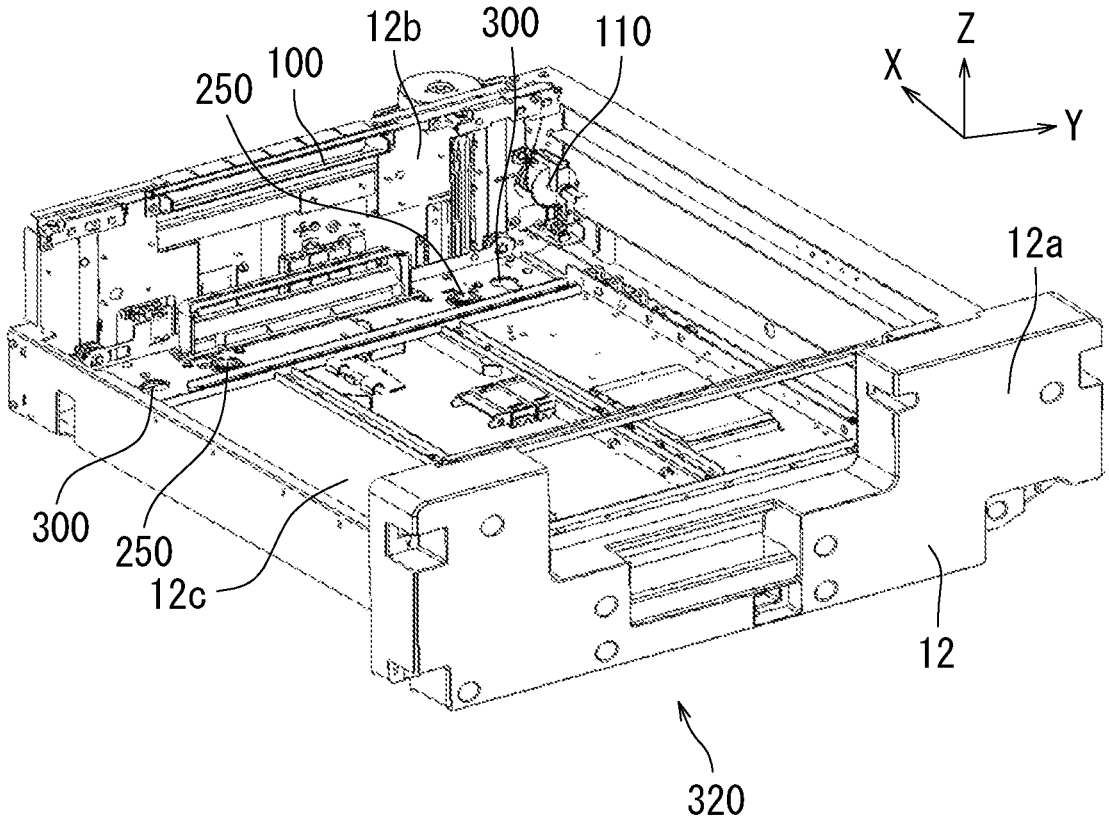
FIG. 7 is a perspective view illustrating a lifting and lowering unit in the embodiment.

As illustrated in FIG. 7, the lifting and lowering unit 320 includes a second casing 12 and a conveyance unit moving mechanism (not illustrated). The second casing 12 is fixed to the housing 2. The second casing 12 includes a wall section 12*a* and a wall section 12*b*, and a support plate 12*c* parallel to the horizontal plane. The wall 12*a* and the wall 12*b* face each other in the X-axis direction. The conveyance unit 51 is placed on the support plate 12*c*.

As illustrated in FIG. 7, the conveyance unit moving mechanism moves, using a wire 100 and a drum 110, the conveyance unit 51 placed on the support plate 12*c* up and down between the upper limit position P1 and the lower limit position P2 in the second casing 12. The loading surface of the conveyance unit 51 at the upper limit position P1 faces the recording head section 4 in the vertical direction. At the upper limit position P1, the loading surface of the conveyance unit 51 is close to the lower end of the recording head section 4 at a clearance sufficient for conveyance of the sheet S (for example, 3 mm). By contrast, at the lower limit position P2, the clearance between the loading surface of the conveyance unit 51 and the lower end of the recording head section 4 is, for example, 200 mm.

Figure 8:
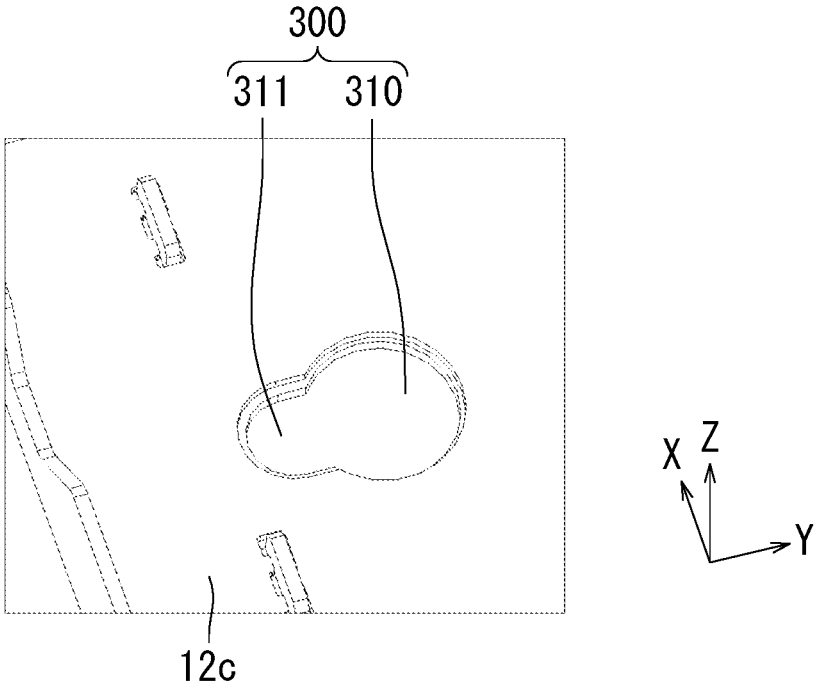
FIG. 8 is an enlarged perspective view illustrating a support plate in the embodiment.

Next, with reference to FIGS. 7 and 8, the support plate 12*c* is described in detail. FIG. 8 is an enlarged perspective view illustrating a support plate 12*c* in the embodiment. As illustrated in FIGS. 7 and 8, the support plate 12*c* includes a plurality of (for example, four) elastic bodies 250 and a plurality of (for example, four) through holes 300. The elastic bodies 250 are disposed on the upper surface of the support plate 12*c*. For example, the four elastic bodies 250 are disposed at a corresponding one of the four corners of the upper surface of the support plate 12*c*. The conveyance unit 51 is placed on the support plate 12*c* with the elastic bodies 250 therebetween.

As illustrated in FIG. 3 and FIG. 8, the through hole 300 has a first hole portion 310 and a second hole portion 311. The first hole portion 310 and the second hole portion 311 penetrate the support plate 12*c* in the axial direction DA. The first hole portion 310 and the second hole portion 311 communicate with each other in a direction DB that intersects the axial direction DA. The first hole portion 310 and the second hole portion 311 communicate with each other in the direction DB that is perpendicular to the axial direction DA in the present embodiment. The second hole portion 311 is smaller than the first hole portion 310. The through hole 300 is located in a vicinity of each elastic body 250.

As illustrated in FIG. 5 and FIG. 6, the first casing 11 includes a wall section 11*a* and a wall section 11*b*. The wall section 11*a* and the wall section 11*b* face each other in the X-axis direction. The cap unit 6 and the wiper unit 7 are attached to the inside of the first casing 11.

The first casing moving mechanism 15 moves the cap unit 6 between the retraction position P3 and a standby position P4 (FIG. 1). The cap unit 6 at the standby position P4 faces the recording head section 4 in the vertical direction.

The first casing moving mechanism 15 moves the wiper unit 7 between the retraction position (indicated by solid lines in FIG. 1) and the standby position. The wiper unit 7 at the standby position faces the recording head section 4 in the vertical direction.

Figure 9:
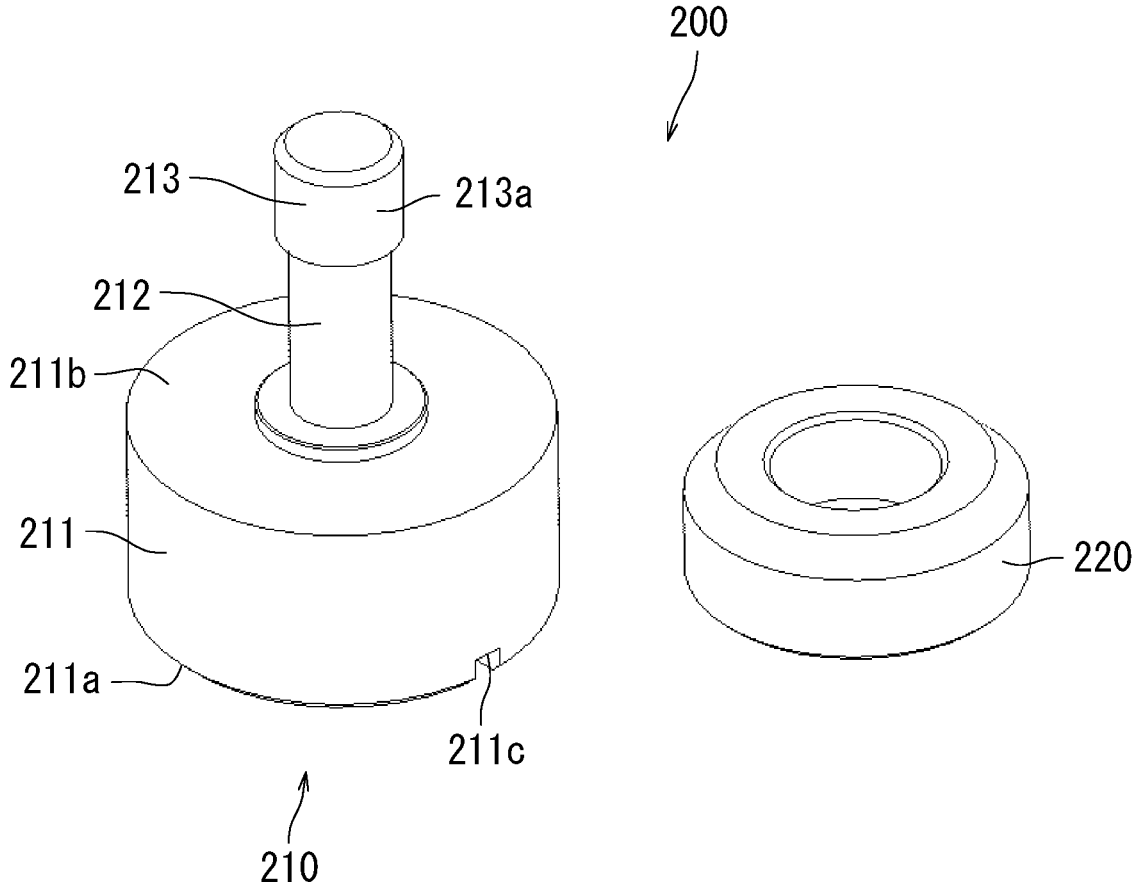
FIG. 9 is an exploded perspective view illustrating the fixing member in the embodiment.

Next, with reference to FIGS. 2, 3, and 9, the fixing member 200 that is used in transportation of the inkjet recording apparatus 1 is described in detail. FIG. 9 is an exploded perspective view illustrating the fixing member 200. As illustrated in FIGS. 2, 3 and 9, the fixing member 200 includes the bolt member 210 and the spacer 220 annular in shape.

The bolt member 210 includes a base portion 211, a protruding portion 212, and a threaded portion 213. The bolt member 210 is made from, for example, metal.

The base portion 211 includes a base end surface 211*a*, a front end surface 211*b*, and an engaging part 211*c*. The base end surface 211*a* and the front end surface 211*b* each intersect the axial direction DA. In the embodiment, the base end surface 211*a* and the front end surface 211*b* are each perpendicular to the axial direction DA. The axial direction DA is a direction along an axis AX of the bolt member 210 passing through the threaded portion 213 and the base portion 211. The base end surface 211*a* is located at a position more distant from the threaded portion 213 than the front end surface 211*b*. The engaging part 211*c* is located in the base end surface 211*a*. The engaging part 211*c* engages with a tool. Since the engaging part 211*c* is located in the base end surface 211*a*, a user can use the tool from a side of the base end surface 211*a*. For example, in a configuration in which the nut member 230 is integral with the inkjet recording apparatus 1, the fixing member 200 can be easily attached to the nut member 230 using the tool.

The protruding portion 212 protrudes from the front end surface 211*b* of the base portion 211 in the axial direction DA. The protruding portion 212 has a diameter of the first length LA.

The threaded portion 213 is located at a tip of the protruding portion 212. The outer peripheral surface of the threaded portion 213 includes a male thread 213*a*. The root diameter of the male thread 213*a* is the second length LB longer than or equal to the first length LA. The outer diameter of the male thread 213*a* is the third length LC longer than the second length LB.

The spacer 220 annular in shape is made from, for example, metal. The spacer 220 is, for example, a ring, a square ring, or a hexagonal ring. The spacer 220 has a first abutment surface 220*c* and a second abutment surface 220*d* that are parallel to and face each other. The first abutment surface 220*c* forms an upper surface of a truncated cone. The central part of the second abutment surface 220*d* forms a protrusion 220*e* protruding in a truncated cone shape. In the central part of the first abutment surface 220*c*, a recess 220*b* is formed toward the second abutment surface 220*d*. A bottom surface of the recess 220*b* has a first female thread 220*a* penetrating toward the second abutment surface 220*d* side. The first female thread 220*a* has an inner diameter of the second length LB and a root diameter of the third length LC. A length HA in the thickness direction of the spacer 220 is a predetermined distance. The predetermined distance is a distance that is shorter than the natural length of the elastic body 250 and that inhibit plastic deformation of the elastic body 250. The natural length of the elastic body 250 is a length of the elastic body 250 free from any force applied thereto (not stretched or compressed).

The recess 220*b* extends in a direction from the threaded portion 213 toward the base portion 211. That is, the recess 220*b* is formed in the first abutment surface 220*c* of the spacer 220, which is the surface facing the threaded portion 213. The recess 220*b* has a predetermined size. Specifically, the recess 220*b* has a size large enough to receive the threaded portion 213.

Figure 10:
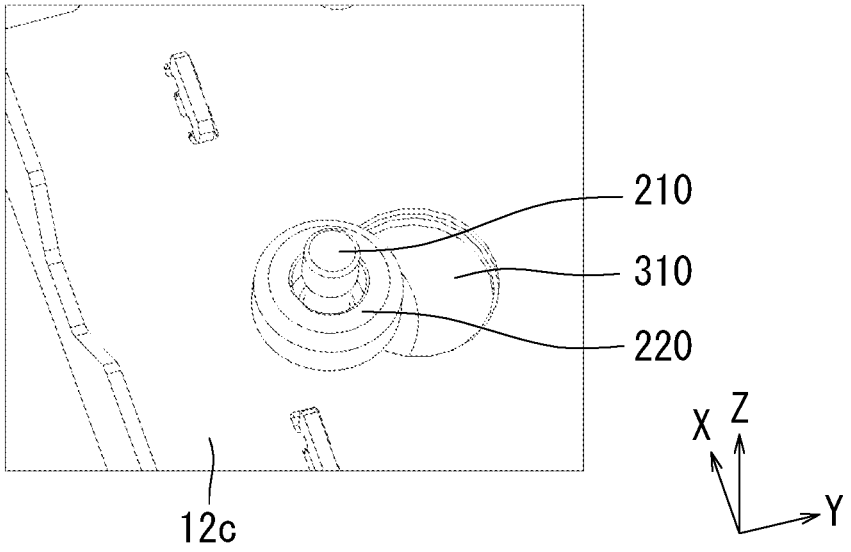
FIG. 10 is a perspective view illustrating how to use the fixing member in the embodiment.
Figure 11:
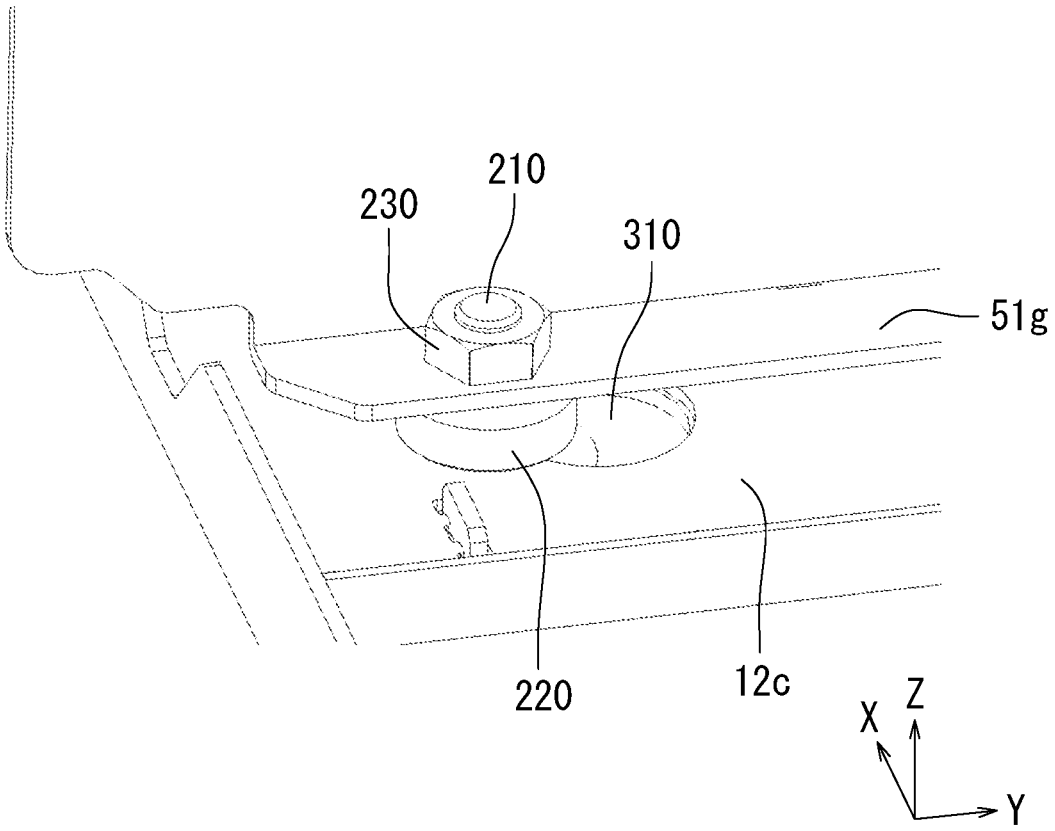
FIG. 11 is another perspective view illustrating how to use the fixing member in the embodiment.

Next, with reference to FIGS. 3, 10, and 11, how to use the fixing member 200 for transportation of the inkjet recording apparatus 1 is described in detail. FIGS. 10 and 11 are each a perspective view illustrating how to use the fixing member 200 in the embodiment.

For transportation of the inkjet recording apparatus 1, the user prepares the bolt member 210 and the spacer 220 as illustrated in FIGS. 3, 10, and 11.

Next, the user attaches the spacer 220 to the protruding portion 212 of the bolt member 210. Specifically, the user first screws the spacer 220 onto the threaded portion 213 of the bolt member 210. After passing through the threaded portion 213, the spacer 220 is attached around the protruding portion 212. The inner diameter of the spacer 220 is the second length LB, and the diameter of the protruding portion 212 is the first length LA. That is, the spacer 220 is slidable on the protruding portion 212. The inner diameter of the spacer 220 is the second length LB, and the diameter of the threaded portion 213 is the third length LC. That is, the spacer 220 cannot be removed from the threaded portion 213 unless it is threadedly rotated. Therefore, in the embodiment, the spacer 220 can be attached to the protruding portion 212 in a slidable manner between the base portion 211 and the threaded portion 213.

Next, the user inserts the protruding portion 212 and the threaded portion 213 of the bolt member 210 with the spacer 220 from the lower side of the first hole portion 310 in the support plate 12*c*. The lower side means an opposite side of the support plate 12*c* to the bottom plate 51*g*. The size of the first hole portion 310 in the support plate 12*c* is such a size that the spacer 220 is allowed to pass therethrough but the base portion 211 is not. The size of the second hole portion 311 in the support plate 12*c* is such a size that neither the spacer 220 nor the base portion 211 is allowed to pass therethrough. The size of the second hole portion 311 is slightly larger than the outer diameter of the bottom surface of the protrusion 220*e*.

Next, the user moves the protruding portion 212 and the threaded portion 213 of the bolt member 210 with the spacer 220 in the direction DB from the first hole portion 310 to the second hole portion 311 in the support plate 12*c*. After the protruding portion 212, the threaded portion 213, and the spacer 220 are moved from the first hole portion 310 to the second hole portion 311 in the through hole 300, the spacer 220 inserted upward from the support plate 12*c* is prevented from falling downward off the support plate 12*c*. Therefore, for example, in a situation in which there is no work space on the bottom plate 51*g* due to the conveyor belt 51*a* being placed thereon, it is possible to pass the fixing member 200 through the support plate 12*c* to arrange the fixing member 200 in the vicinity of the bottom plate 51*g* as long as there is work space below the support plate 12*c*. Furthermore, the spacer 220 includes the protrusion 220*e* having a diameter smaller than that of the second hole portion 311 and protruding toward the second hole portion 311. Accordingly, the protrusion 220*e* is engaged with the second hole portion 311, and thus the spacer 220 is positioned so as not to move out of the second hole portion 311. Since the periphery of the first abutment surface 220*c* has a truncated cone shape, it is possible to prevent the periphery of the spacer 220 from interfering with the end of the bottom plate 51*g*.

Finally, the user inserts the threaded portion 213 of the bolt member 210 through the third hole 51*f* in the support plate 12*c* and screws the threaded portion 213 into the nut member 230. The user engages a tool with the engaging part 211*c* to screw the threaded portion 213 into the nut member 230. Since the engaging part 211*c* is located on the base end surface 211*a*, the user can use the tool from the side of the base end surface 211*a*. Therefore, in a situation in which there is no work space on the bottom plate 51*g* due to the conveyor belt 51*a* being placed thereon, the fixing member 200 can be attached to the nut member 230 as long as there is work space below the support plate 12*c*.

As a result of the threaded portion 213 screwed into the nut member 230, the support plate 12*c* is sandwiched between the base portion 211 and the spacer 220. The support plate 12*c* is an example of a first member. The bottom plate 51*g* is sandwiched between the spacer 220 and the nut member 230 threadedly engaged with the threaded portion. The bottom plate 51*g* is an example of a second member. The length of the elastic body 250 is kept at the predetermined length HA between the bottom plate 51*g* and the support plate 12*c* due to the presence of the spacer 220.

Therefore, according to the embodiment, due to the presence of the spacer 220 between the bottom plate 51*g* and the support plate 12*c*, the bottom plate 51*g* and the support plate 12*c* can be fixed with a space therebetween. When the elastic bodies 250 are arranged between the bottom plate 51*g* and the support plate 12*c*, the length of the elastic body 250 is kept at the predetermined length HA between the bottom plate 51*g* and the support plate 12*c* due to the presence of the spacer 220. Accordingly, plastic deformation of the elastic body 250 present between the bottom plate 51*g* and the support plate 12*c* can be inhibited. Further, the conveyance unit 51 can be prevented from being damaged.

Subsequently, how to bring the inkjet recording apparatus 1 into a state ready to use after transportation to a destination is described in detail.

First, the user engages the tool with the engaging part 211*c* to unscrew the threaded portion 213 of the bolt member 210 for detachment from the nut member 230. Since the engaging part 211*c* is located in the base end surface 211*a*, the user can use the tool from the side of the base end surface 211*a*. Therefore, in a situation in which there is no work space on the bottom plate 51*g* due to the conveyor belt 51*a* being placed thereon, the fixing member 200 can be detached as long as there is work space below the support plate 12*c*.

Next, the user pulls the base portion 211 downward to insert the threaded portion 213 of the bolt member 210 into the recess 220*b* of the spacer 220. Thus, the bolt member 210 previously located above the bottom plate 51*g* is retracted, and as a result, the bolt member 210 with the spacer 220 can be moved in the horizontal direction DB.

Next, the user moves the protruding portion 212 and the threaded portion 213 of the bolt member 210 with the spacer 220 in the direction DB from the second hole portion 311 to the first hole portion 310 in the support plate 11*c*. As a result of the movement of the protruding portion 212, the threaded portion 213, and the spacer 220 from the second hole portion 311 to the first hole portion 310 in the through hole 300, the spacer 220 that could not be pulled downward out of the support plate 12*c* can be pulled downward out of the support plate 12*c*.

Finally, the user pulls the base portion 211 downward to pull out the protruding portion 212 and the threaded portion 213 of the bolt member 210 with the spacer 220 through the first hole portion 310 in the support plate 12*c*. Therefore, in a situation in which there is no work space on the bottom plate 51*g* due to the conveyor belt 51*a* being placed thereon, the fixing member 200 can be collected as long as there is work space below the support plate 12*c*.

Hereinbefore, an embodiment of the present disclosure has been described with reference to the drawings. However, the present disclosure is not limited to the above embodiment and may be implemented in various different forms that do not deviate from the essence of the present disclosure. The drawings schematically illustrate elements of configuration in order to facilitate understanding, and properties of elements of configuration illustrated in the drawings, such as thicknesses, lengths, and numbers thereof, may differ from actual properties thereof in order to facilitate preparation of the drawings. Shapes, dimensions, and the like of the elements of configuration given in the above embodiment are merely examples that do not impose any particular limitations and may be altered in various ways so long as such alterations do not substantially deviate from the configuration of the present disclosure.

(1) As described with reference to FIGS. 1 to 11, the image forming apparatus is an inkjet recording apparatus 1. However, the present disclosure is not limited thereto. The image forming apparatus may be, for example, an electrophotographic recording apparatus or a monochrome multifunction peripheral.

Figure 12:
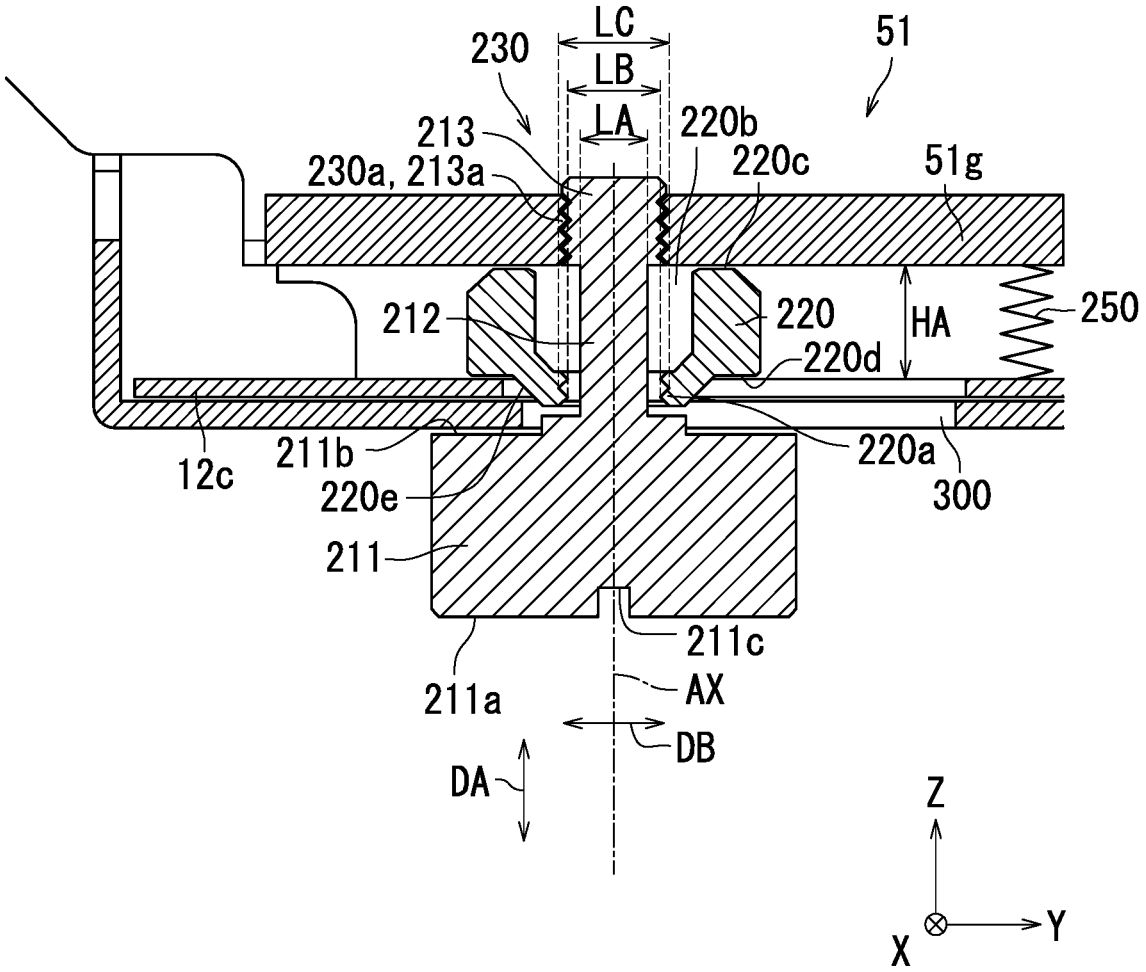
FIG. 12 is a cross-sectional view illustrating a bottom plate and the fixing member in the embodiment.

(2) As described with reference to FIGS. 1 to 11, the nut member 230 is fixed to the bottom plate 51*g*. However, the present disclosure is not limited thereto. The nut member 230 does not need to be fixed to the bottom plate 51*g*. The nut member 230 may be a threaded hole 230*a* (a second female thread) as a result of processing on the bottom plate 51*g*. With reference to FIG. 12, the bottom plate 51*g* is described. FIG. 12 is a cross-sectional view illustrating the bottom plate 51*g* and the fixing member 200. As illustrated in FIG. 12, the bottom plate 51*g* has the second female thread 230*a*. The second female thread 230*a* functions as the nut member 230. That is, the nut member 230 and the bottom plate 51*g* are integral as a single member.

What is claimed is:

1. An image forming apparatus comprising:

a first member including a bottom plate;

a second member including an elastic body and a support plate that supports the first member with the elastic body interposed therebetween and movably holding the first member; and a fixing member configured to fix the first member to the second member, wherein the fixing member includes:

a bolt member; and a spacer annular in shape, wherein the bolt member includes:

a base portion;

a protruding portion protruding from the base portion; and a threaded portion located at a tip of the protruding portion, the spacer is attached to the protruding portion in a slidable manner between the base portion and the threaded portion;

the second member is sandwiched between the base portion and the spacer, and the first member is sandwiched between the spacer and a nut member threadedly engaged with the threaded portion.

2. The image forming apparatus according to claim 1, wherein the protruding portion has a diameter of a first length, the threaded portion includes a male thread, the male thread has a root diameter of a second length longer than the first length and an outer diameter of a third length longer than the second length, the spacer includes a first female thread, the first female thread of the spacer has an inner diameter of the second length and a root diameter of the third length, the nut member includes a second female thread, and the second female thread of the nut member has an inner diameter of the second length and a root diameter of the third length.

3. The image forming apparatus according to claim 1, wherein the spacer includes a recess extending from the threaded portion to the base portion, and the threaded portion is capable of being received by the recess.

4. The image forming apparatus according to claim 1, wherein the base portion includes a base end surface, a front end surface, and an engaging part, the engaging part being to be engaged with a tool, the base end surface and the front end surface each intersect an axial direction, the axial direction is a direction along an axis of the bolt member passing through the threaded portion and the base portion, the base end surface is located at a position more distant from the threaded portion than the front end surface, and the engaging part is located in the base end surface.

5. The image forming apparatus according to claim 1, wherein the support plate has a first hole portion and a second hole portion smaller than the first hole portion, the first hole portion and the second hole portion each penetrate the support plate in an axial direction, the axial direction is a direction along an axis of the bolt member passing through the threaded portion and the base portion, the first hole portion and the second hole portion communicate with each other in a direction that intersects the axial direction, the spacer is allowed to pass through the first hole portion and is not allowed to pass through the second hole portion, and the base portion is not allowed to pass through neither of the first hole portion nor the second hole portion.

6. The image forming apparatus according to claim 5, wherein the bottom plate has a third hole, and the nut member is fixed to the bottom plate so as to overlap with the third hole in the axial direction.

7. The image forming apparatus according to claim 5, wherein the spacer includes a protrusion having a diameter smaller than that of the second hole portion and protruding toward the second hole portion.

8. The image forming apparatus according to claim 1, wherein the bottom plate has a female thread, and the female thread functions as the nut member.

9. An image forming apparatus comprising:

a conveyance unit including a bottom plate and configured to convey a sheet, a lifting and lowering unit including an elastic body and a support plate, and configured to lift and lower the conveyance unit, the support plate supporting the conveyance unit with the elastic body therebetween, a fixing member configured to fix the conveyance unit to the lifting and lowering unit, and a nut member to be attached onto the fixing member, wherein the fixing member includes:

a bolt member; and a spacer annular in shape, the bolt member includes:

a base portion;

a protruding portion protruding from the base portion; and a threaded portion located at a tip of the protruding portion, the spacer is attached to the protruding portion in a slidable manner between the base portion and the threaded portion, the support plate is sandwiched between the base portion and the spacer, the bottom plate is sandwiched between the spacer and the nut member threadedly engaged with the threaded portion, and the length of the elastic body is maintained at a predetermined length due to the spacer between the bottom plate and the support plate.

10. The image forming apparatus according to claim 9, wherein the support plate has a first hole portion and a second hole portion smaller than the first hole portion, the first hole portion and the second hole portion each penetrate the support plate in an axial direction, the axial direction is a direction along an axis of the bolt member passing through the threaded portion and the base portion, the first hole portion and the second hole portion communicate with each other in a direction that intersects the axial direction, the spacer is allowed to pass through the first hole portion and is not allowed to pass through the second hole portion, and the base portion is not allowed to pass through neither of the first hole portion nor the second hole portion.

11. The image forming apparatus according to claim 10, wherein the bottom plate has a third hole, and the nut member is fixed to the bottom plate so as to overlap with the third hole in the axial direction.

12. The image forming apparatus according to claim 10, wherein the spacer includes a protrusion having a diameter smaller than that of the second hole portion and protruding toward the second hole portion.

13. The image forming apparatus according to claim 9, wherein the bottom plate has a female thread, and the female thread functions as the nut member.

* * * * *